US006079182A

United States Patent [19]

Ellenberger

[11] Patent Number: 6,079,182

[45] Date of Patent: Jun. 27, 2000

[54] FLOOR PANEL COMPRESSING APPARATUS AND METHOD

[76] Inventor: Jack Richard Ellenberger, 8355 NE. Loughrey Ave., Indianola, Wash. 98342

[21] Appl. No.: 08/965,057

[22] Filed: Nov. 5, 1997

[51] Int. Cl.[7] ..... E04F 21/22

[52] U.S. Cl. ..... 52/749.1; 52/747.1; 52/DIG. 1; 254/11; 269/904; 242/396.1; 242/395

[58] Field of Search ..... 52/747.1, 749.1, 52/DIG. 1; 254/11, 12, 13, 14, 15, 16, 17; 269/43, 904; 24/68 R, 68 D, 269, 909; 242/405.2, 405, 395, 395.1, 396.1, 916; 81/46

[56] References Cited

U.S. PATENT DOCUMENTS

| | | | |
|---|---|---|---|
| 84,919 | 12/1868 | Valentine et al. | 242/396.1 |
| 527,474 | 10/1894 | Bates . | |
| 561,003 | 5/1896 | Kinderman . | |
| 690,175 | 12/1901 | McKenzie . | |
| 787,055 | 4/1905 | Schreidt . | |
| 999,641 | 8/1911 | Fuerst | 242/396.1 |
| 1,094,449 | 4/1914 | Lauri | 254/13 |
| 1,115,737 | 11/1914 | Prochnow . | |
| 1,461,991 | 7/1923 | Walker . | |
| 1,567,483 | 12/1925 | Bear . | |
| 1,781,833 | 11/1930 | Cummer . | |
| 2,247,780 | 7/1941 | Klammit | 52/749.1 X |
| 2,710,166 | 6/1955 | Miller . | |
| 3,143,335 | 8/1964 | Lassahn . | |
| 3,806,059 | 4/1974 | Quenot | 242/395.1 X |
| 3,881,694 | 5/1975 | Gardner | 24/68 R |
| 4,753,426 | 6/1988 | Varkala | 254/11 X |
| 4,986,043 | 1/1991 | Love | 52/749.1 X |
| 5,339,507 | 8/1994 | Cox | 52/749.1 X |
| 5,435,610 | 7/1995 | Roberts . | |
| 5,788,221 | 8/1998 | Muhlebach et al. | 254/16 |

FOREIGN PATENT DOCUMENTS

| | | |
|---|---|---|
| 4304992 | 9/1993 | Germany . |

*Primary Examiner*—Laura A. Callo

*Attorney, Agent, or Firm*—Gene Scott-Patent Law & Venture Group

[57] ABSTRACT

The present invention provides a floor board compressing apparatus and method of use for compressing and tightening a plurality of abutting floor boards. The apparatus has a reel rotationally engaged in a reel housing. An inextensible and flexible tape coiled on and attached to the reel extends to a first hook which attaches to the first end of the boards to be compressed. A second hook is pivotally attached to the reel housing and attaches to the opposing end of the floor boards. A handle which is pivotally engaged to the reel is used to turn the reel within the reel housing so as to draw the first hook toward the second hook. The reel housing preferably includes a plurality of holes and the handle provides a locking peg. After winding in all of the flexible tape by turning the handle, the handle is then rocked on its pivot for engaging and disengaging the locking peg with any one of the locking holes. After the tape has been tightened and locked into place, the reel housing is pushed laterally. This lateral movement exerts a steady and uniform pressure which pulls the boards into a tight fitting configuration.

7 Claims, 3 Drawing Sheets

FLOOR PANEL COMPRESSING APPARATUS AND METHOD

This application discloses and claims matter described in disclosure document no. 415872 at the United States Patent Office, having a filing date of Mar. 17, 1997 and entitled: Device To Compress Laminate Floor Panels.

BACKGROUND OF THE INVENTION

1. Field of the Invention

This invention relates generally to clamping devices and a method for constructing flooring and the like, and more particularly to a floor panel compression apparatus and method.

2. Description of Related Art

When professionals install a laminate flooring, they are faced with the problem of forcing the boards into close contact with each other so as to form a stable and uniform fit. Without the use of some sort of clamp, the flooring needs to be struck with a beater bar or tapping block and hammer to try to force the joints together. This pounding usually causes the boards which have already been set to shift and this causes gaps to appear. Various devices have been developed to overcome these problems. The following art defines the present state of this field:

Bates, U.S. Pat. No. 527,474 describes an invention that relates to certain new and useful improvements in devices used in laying floors, ceiling, decking, etc., and especially to the construction of a floor dog, which is constructed of metal and is provided with retaining spikes which are designed to hold the clamp to a joist at any desired angle to the flooring, so as to conform to the wedge to be used in connection with the floor set.

Kinderman, U.S. Pat. No. 561,003 describes a new and improved weather-board clamp which is simple and durable in construction and more especially designed for drawing tongued and grooved weather-boards together preparatory to nailing the same in place.

McKenzie, U.S. Pat. No. 690,175 describes a clamp adapted to bring to and hold in place boards or planks which when in their final position are curved or present irregular surfaces, the invention being intended particularly for use of boat-builders in bringing to place the external planks of the hull and holding the same while they are being permanently secured.

Schreidt, U.S. Pat. No. 787,055 describes a fishing pole wherein the movement of the reel is accomplished by a minimum amount of friction when running freely and which has a brake which may be readily applied to check the speed of the reel and in which the reel may be readily locked in any desired position when the length of the pole is altered.

Prochnow, U.S. Pat. No. 719,905 describes improvements in strap supports for guns, the object of the invention being to provide means whereby the spool may be manually actuated.

Walker, U.S. Pat. No. 1,461,991 describes a tightener with a member for engaging the side of the lumber, and a co-operating member adapted to engage a support, which members when tightened will draw the lumber together.

Bear, U.S. Pat. No. 1,567,483 describes a simple means for housing a chalk line, to protect soiling of the chalk line, or the distribution of chalk dust therefrom upon other object in a tool box or other receptacle within which my chalk line may be carried, along with other tools or materials.

Cummer, U.S. Pat. No. 1,781,833 describes a sliding clamp especially for carpenter's use in putting on siding and an object of the invention is to provide a tool which will draw siding boards together and hold them for nailing.

Miller, U.S. Pat. No. 2,710,166 describes tools and facilities employable in the fitting and laying of flooring boards, and more particularly to means for positively interfitting and holding in place successive elements of tongue-and-groove flooring during the laying thereof over and against a sub-floor, and has as an object to provide an improved flooring clamp characterized by convenience and facility of use.

Lassahn, U.S. Pat. No. 3,143,335 describes clamping devices and a method for constructing flooring and the like, and more particularly to a construction clamp useful in the construction business to urge abutting edges of a plurality of boards into close contact until they can be fastened in place.

Roberts, U.S. Pat. No. 5,435,610 describes the device and method of the invention that enables a single workman to drive a tongue and groove sub-flooring panel into mating connection with a pre-laid sub-floor panel without the use of a sledgehammer. The device fits over and receives and is secured to the usual driving plank as an operative part thereof.

The prior art teaches various mechanisms. However, the prior art does not teach an apparatus or method which is easy to use and capable of providing constant and uniform compression on the various boards. The present invention fulfills these needs and provides further related advantages as described in the following summary.

SUMMARY OF THE INVENTION

The present invention teaches certain benefits in construction and use which give rise to the objectives described below.

The present invention provides a floor board compressing apparatus and method of use for compressing and tightening a plurality of abutting floor boards. The apparatus has a reel rotationally engaged in a reel housing. An inextensible and flexible tape coiled on and attached to the reel extends to a first means for hooking which attaches to the first end of the boards to be compressed. A second means for hooking is pivotally attached to the reel housing and attaches to the opposing end of the floor boards. A winding means such as a handle is used to turn the reel within the reel housing so as to draw the first means for hooking toward the second means for hooking. In its preferred form, the winding means is a handle which is pivotally engaged with the reel. The reel housing preferably includes a first engagement means, preferably a plurality of holes, and the handle provides a second engagement means, preferably a locking peg. After the first and second hooking means of the apparatus have been attached to the opposing edges of a series of boards, the handle is turned to wind in all of the flexible tape. The handle is then rocked on its pivot for engaging and disengaging the locking peg with any one of the locking holes, locking the apparatus in place. After the tape has been tightened and locked into place, the reel housing is pushed laterally. This lateral movement exerts a steady and uniform pressure which pulls the boards into a tight fitting configuration.

A primary objective of the present invention is to provide a clamping device and method of use which will make the laying of laminate flooring easier and more economical, thereby lowering construction costs as well as raising quality of work. Such a device and method of use have advantages not taught by the prior art.

Another objective is to provide a clamping device and method of use which allows a single worker to efficiently lay high quality flooring, thus eliminating the need to repair bad flooring and also eliminating the need for additional effort or manpower, thus lowering costs.

A further objective is to provide a clamping device and method of use which allows a worker to lay boards which are even and which tightly abut each other, thereby forming a superior laminate flooring.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

Figure 1:
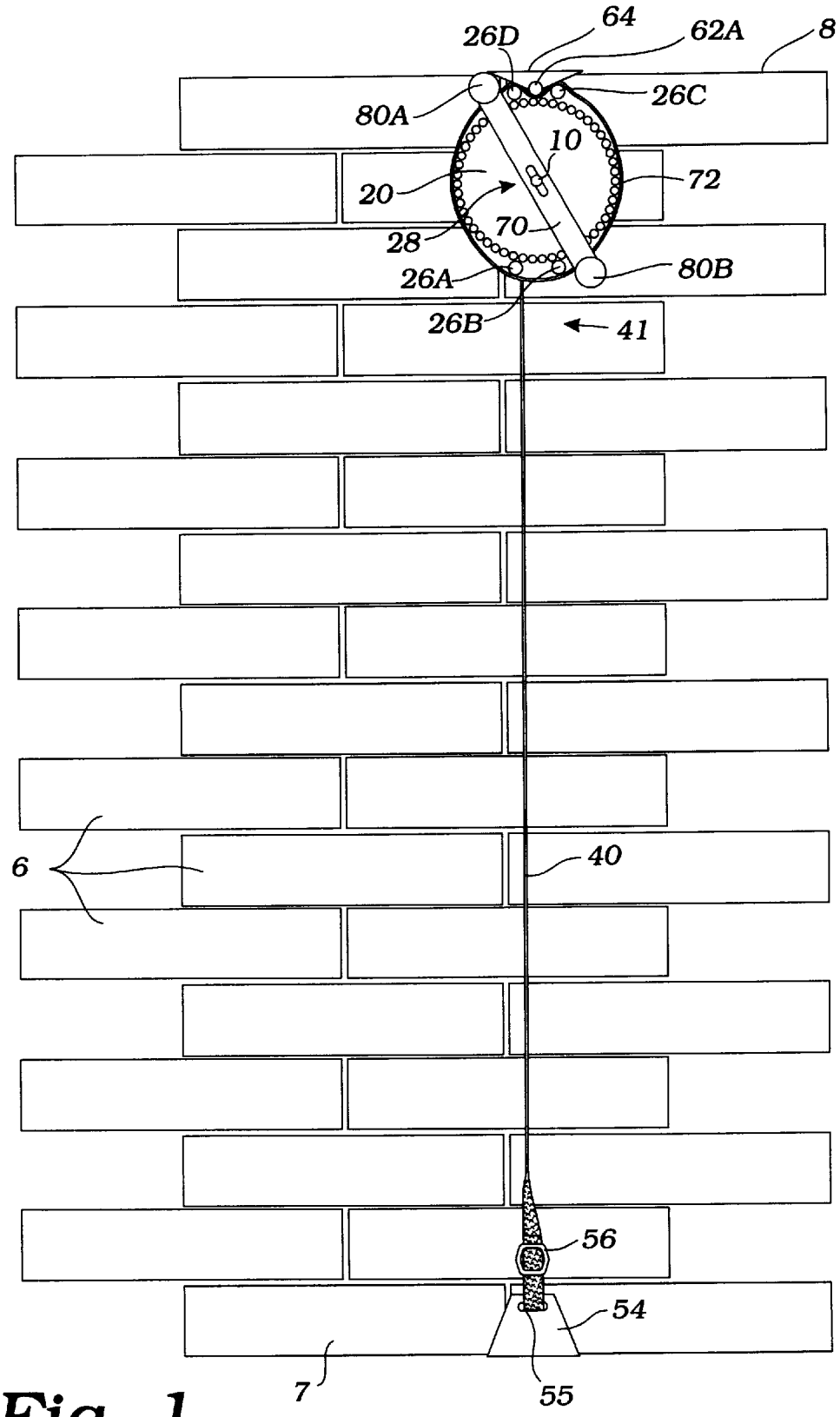
FIG. 1 is a plan view of the preferred embodiment of the apparatus of the present invention shown engaged with floor boards.
Figure 2:
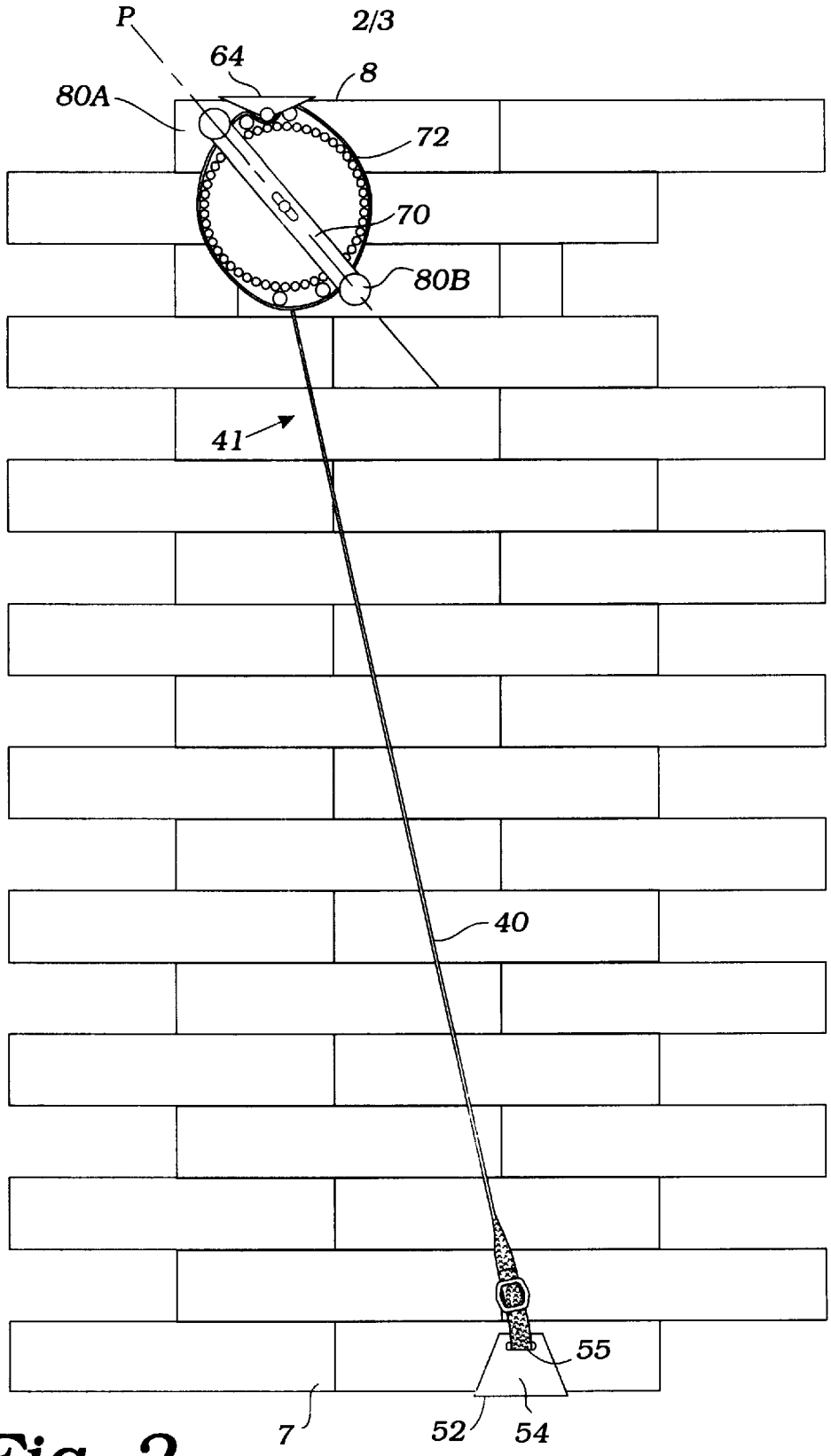
FIG. 2 is a plan view similar to that of FIG. 1 wherein a hooking portion of the apparatus is shown moved laterally for tightening the boards.

The above described drawing figures illustrate the invention, a floor board compressing apparatus 4 for use in compressing and tightening a plurality of abutting floor boards 6, each having a first edge 7, and an opposing edge 8. The apparatus 4 has a reel 10 rotationally engaged in a reel housing 20. The reel housing 20 is preferably a circular top plate 22 approximately eight inches in diameter connected at its perimeter to a matching bottom plate 24 with a plurality of connecting struts 26. The top plate 22 has a reel accepting hole 28 at its center for accepting the reel 10. The reel 10 is preferably a rod or cylinder which is rotatably engaged within the reel accepting hole 28. The reel 10 preferably has a slit 30 through the rod, or pair of slits if the reel 10 is a cylinder. The reel 10 and the reel housing 20 are preferably made of a strong and durable material such as stainless steel, and the reel housing 20 is preferably about eight inches in diameter An inextensible and flexible tape 40 is coiled on the reel 10 and preferably made of a length of woven nylon approximately 24 inches long and ¼ inch wide. The flexible tape 40 has an attached end 41 and extends from the reel 10 to form a free end 42. The attached end 41 is attached to the reel 10, preferably by passing the attached end 41 through the slit 30 in the reel 10 and then folding the flexible tape 40 back on itself and sewing the attached end 41 to the flexible tape 40. The free end 42 of the flexible tape 40 is attached a first means for hooking 50. The first means for hooking 50 is preferably an L-shaped hook 50 made of stainless steel having a base 52 which is wide enough to attach to the first edge 7 of a floorboard 6. The L-shaped hook 50 also has an extended arm 54 lo having a means for strap attachment, preferably a hook hole 55 and a fastening ring 56. Alternatively, the free end 42 can simply be passed through the hook hole 55, folded back and sewn to itself.

A second means for hooking 60 is pivotally attached to the reel housing 20. It preferably has an eyelette 61 for attachment to a hooking bolt 62 attached to the bottom plate 24. The hooking bolt 62 is either screwed into the bottom plate 24 or passed through a bottom plate attachment hole 63 and fastened with a locking nut 62A. In its preferred form, the second means for hooking 60 has an edge engagement tongue 64 having an angled surface that contacts the opposing edge 8 of the floor board 6. A pair of the connecting struts 26A and 26B are preferably placed around the bottom plate attachment hole 63. Another pair of the connecting struts 26C and 26D are also preferably placed opposite the bottom plate attachment hole 63. The free end 42 of the flexible tape 40 is preferably threaded out from between the pair of connecting struts 26C and 26D to facilitate holding the flexible tape 40 in place while the floor board compressing apparatus 4 is in use.

A winding means 70 provides a means for winding the reel 10 within the reel housing 20 so as to draw the first means for hooking 50 toward the second means for hooking 60. In its preferred form, the winding means is a handle which is pivotally engaged with the reel 10. The reel housing 20 preferably includes a first engagement means 72 and the handle 70 provides a second engagement means 74. The first and second engagement means 72 and 74 cooperating for locking the reel 10 at any one of a plurality of rotational positions P for establishing a compressive force in the floor boards 6. In its preferred form, the first engagement means 72 is a plurality of locking holes 72 arranged in a circle about the perimeter of the reel housing 20. The handle 70 is pivotally attached to the reel 10. The second engagement means 74 is a locking peg 76 extending from the handle 70, the peg being positionable into any one of the locking holes 72. After winding in all of the flexible tape 40 by turning the handle 70, the handle is then rocked on its pivot for engaging and disengaging the locking peg 76 with any one of the locking holes 72. To facilitate use of the floor panel compression apparatus 4, the handle 70 is preferably connected to the reel 10 at the center of the handle 70. Each arm 70A and 70B of the handle 70 extends to the perimeter of the reel housing 20 for locking peg 76 engagement with the appropriate locking hole 72. It is preferred that each arm 70A and 70B of the handle 70 extend slightly beyond the reel housing 20 for better leverage. Color coded knobs 80A and 80B are rotatably attached to the end of each end 70A and 70B of the handle 70 to facilitate turning the handle 70. The color coding on the color coded knobs 80A and 80B facilitates identification of which end of the handle 70A and 70B has the locking peg 76, for locking and unlocking the handle 70.

Figure 3:
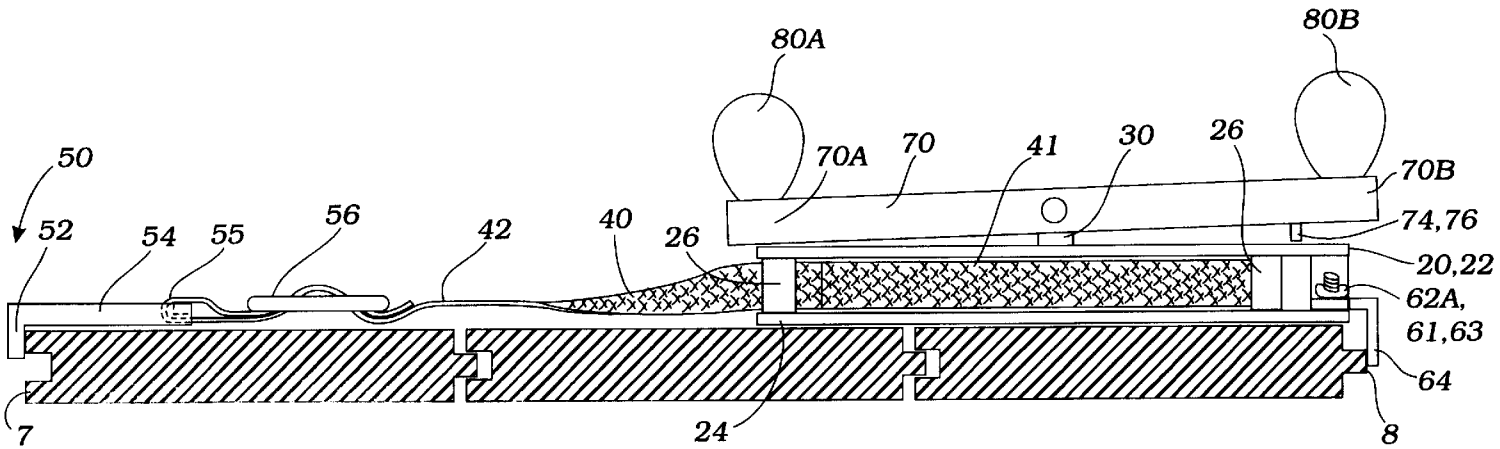
FIGS. 3 and 4 are side elevational views of the apparatus of the present invention whereby a rocking feature of a handle of the invention is illustrated.
Figure 4:
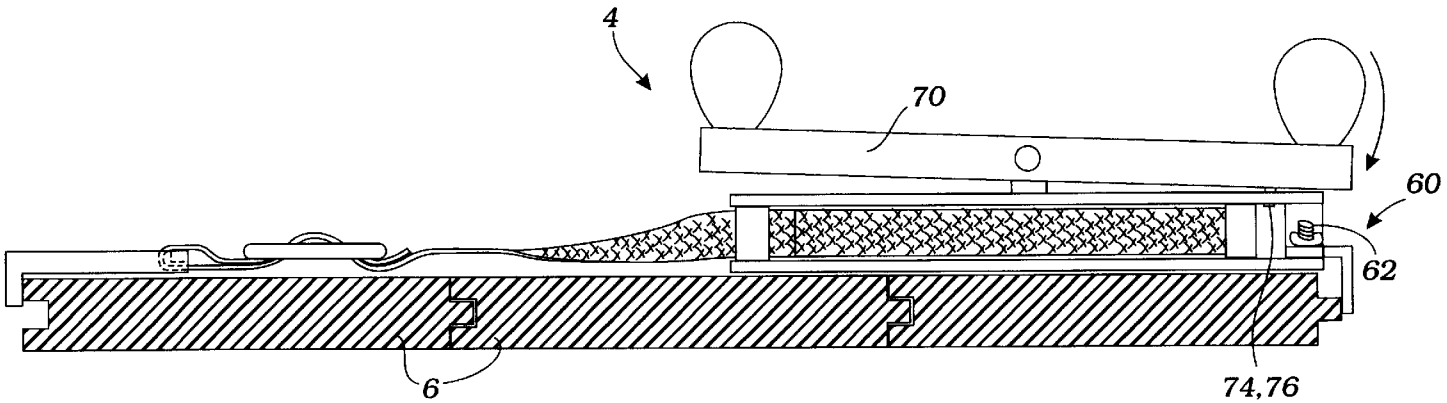

The invention also includes a method for using the above described a floor board compressing apparatus 4 for compressing abutting floor boards 6. The method comprises several steps. First, it is necessary to provide the above described floor board compressing apparatus 4. It is preferred that a plurality of these floor board compressing apparatuses 4 be used when installing floor boards 6 in an average room. It is recommended that six of the floor board compressing apparatuses 4 be used at the same time for best results. The recommended procedure may vary according to the specific floor boards 6 being installed; however, the basic procedure is that the first course of floor boards 6 is placed within ⅜ inch from the straightest wall. You grasp the free end 42 of the flexible tape 40 and unreel it so as to extend the first means for hooking 50, preferably an L-shaped hook 50, to the first edge 7 of a plurality of abutting floor boards 6. After attaching the base 52 of the L-shaped hook 50 with the first edge 5 of the floor boards 6, the edge engagement tongue 64 of the second means for hooking 60 is engaged with the opposing edge 8 of the floor boards 6. Once the first and second means for hooking 50 and 60 respectively are attached, the handle 70 is turned to rotate the reel 10 and draw in the flexible tape 40 in so as to draw a tension in the flexible tape 40. Once the flexible tape 40 is taut, the handle 70 is locked into a position for maintaining the tension in the flexible tape 40. In its preferred mode, the handle 70 is rocked to that the locking peg 76 fits into one of the locking holes 72, fixing the handle in a rotational position P. Finally, as shown in FIGS. 3–4, by sliding the reel housing 20 laterally along the floorboard ridge 8 of the floor boards 6 so as to increase the tension in the flexible tape 40 and to eliminate any spaces between the floor boards 6. This procedure is repeated with all of the boards 6 until the entire course has been set. Then the first and second means for hooking 50 and 60 are removed, another course of boards is set, and the above described tightening procedure is repeated.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A floor panel compressing apparatus for use in compressing and tightening a plurality of abutting floor boards, the apparatus comprising:

a reel rotationally engaged in a reel housing for rotating therein;

an inextensible and flexible tape coiled on the reel and extending therefrom to form a free end of the flexible tape positioned remotely from the reel;

a first means for hooking attached to the free end of the flexible tape;

a second means for hooking attached to the reel housing;

a means for winding the reel within the reel housing so as to draw the first means for hooking toward the second means for hooking so as to reduce spaces between the floor boards when the first and second means for hooking are engaged with the floor boards;

the reel housing providing a first engagement means, the winding means providing a second engagement means, the first and second engagement means cooperating by rotational and rocking motion functionally enabled in the winding means for locking the reel at any one of a plurality of rotational positions for establishing a compressive force in the floor boards.

2. The apparatus of claim 1 wherein the first engagement means is a plurality of holes arranged in a circle about the reel housing, a rotational axle of the winding means being centered therein, and the second engagement means is a peg extending from the winding means, the peg being positionable into any one of the holes.

3. The apparatus of claim 1 wherein the second means for hooking is pivotally attached to the reel housing for enabling the reel housing to move laterally.

4. The apparatus of claim 1 wherein the first and second means for hooking each provide an edge engagement tongue, the engagement tongue providing an angled surface positioned such that a board edge surface in contact therewith tends to further engage the means for hooking.

5. A method for compressing abutting floor boards, the method comprising the steps of:

a) providing a reel rotationally engaged in a reel housing for rotating therein, an inextensible and flexible tape coiled on the reel and extending therefrom to form a free end of the flexible tape engaged with a first means for hooking, a second means for hooking attached to the reel housing, and a means for winding the reel within the reel housing;

b) unreeling the flexible tape so as to extend the first hooking means to one edge of a plurality of abutting floor boards;

c) engaging the first hooking means with the one edge of the floor boards;

d) engaging the second hooking means with the other edge of the floor boards;

e) reeling the flexible tape in so as to draw a tension in the tape;

f) providing a first and second engagement means for locking the reel at any one of a plurality of rotational positions;

g) locking the winding means into a position for maintaining the tension in the tape;

h) sliding the reel housing laterally along the other edge of the floor boards so as to increase the tension in the tape and to eliminate any spaces between the floor boards.

6. The method of claim 5 wherein step (g) includes rocking a handle of the winding means for inserting a peg into a hole.

7. The method of claim 5 wherein in step (a), the second hooking means is provided as pivotally attached to the reel housing.

* * * * *